US009225121B2

(12) United States Patent
Chang et al.

(10) Patent No.: US 9,225,121 B2
(45) Date of Patent: Dec. 29, 2015

(54) LOW CROSSTALK ELECTRICAL CONNECTOR

(71) Applicant: HON HAI PRECISION INDUSTRY CO., LTD., New Taipei (TW)

(72) Inventors: Yen-Chih Chang, New Taipei (TW); Tzu-Yao Hwang, New Taipei (TW); Ke-Hao Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 61 days.

(21) Appl. No.: 14/262,814

(22) Filed: Apr. 28, 2014

(65) Prior Publication Data

US 2014/0329408 A1 Nov. 6, 2014

(30) Foreign Application Priority Data

May 2, 2013 (TW) ..... 102115638 U

(51) Int. Cl.

| | |
|---|---|
| ***H01R 13/648*** | (2006.01) |
| ***H01R 13/6585*** | (2011.01) |
| *H01R 12/71* | (2011.01) |
| *H01R 13/24* | (2006.01) |
| *H01R 13/405* | (2006.01) |
| *H01R 13/6477* | (2011.01) |

(52) U.S. Cl.

CPC ..... *H01R 13/6585* (2013.01); *H01R 12/714* (2013.01); *H01R 13/2442* (2013.01); *H01R 13/405* (2013.01); *H01R 13/6477* (2013.01)

(58) Field of Classification Search

CPC ..... H01R 13/646; H01R 13/65802; H01R 13/6588; H01R 13/6461; H01R 23/6873; H01R 23/688; H01R 13/02

USPC ..... 439/66, 65, 607.4, 607.1, 607.8, 607.9

See application file for complete search history.

(56) References Cited

U.S. PATENT DOCUMENTS

| | | | | |
|---|---|---|---|---|
| 5,380,210 | A * | 1/1995 | Grabbe et al. | 439/66 |
| 7,445,461 | B1 * | 11/2008 | Polnyi | 439/66 |
| 7,695,288 | B2 * | 4/2010 | Ma et al. | 439/70 |
| 2008/0182452 | A1 * | 7/2008 | Ma | 439/607 |
| 2012/0202363 | A1 * | 8/2012 | McNamara et al. | 439/74 |
| 2014/0335731 | A1 * | 11/2014 | Chang et al. | 439/620.13 |
| 2014/0349518 | A1 * | 11/2014 | Chang et al. | 439/607.01 |
| 2014/0377992 | A1 * | 12/2014 | Chang et al. | 439/607.1 |

FOREIGN PATENT DOCUMENTS

| | | |
|---|---|---|
| CN | 202196955 | 1/2012 |

* cited by examiner

*Primary Examiner* — Abdullah Riyami
*Assistant Examiner* — Nader J Alhawamdeh
(74) *Attorney, Agent, or Firm* — Wei Te Chung; Ming Chieh Chang

(57) ABSTRACT

An electrical connector includes contact units and housing units for retaining the contact units. The contact unit includes an insulating body and a plurality of contacts retained therein. The housing unit includes a shielding member defining an upper end and a lower end opposite to each other, an insulating cover seated on the upper end of the shielding member, and an insulating base seated on the lower end of the shielding member. A cavity is defined between the insulating cover and the insulating base for decreasing the plastic content so as to reduce the crosstalk.

20 Claims, 4 Drawing Sheets

LOW CROSSTALK ELECTRICAL CONNECTOR

BACKGROUND OF THE INVENTION

1. Field of the invention

The present disclosure relates to an electrical connector, and more particularly to an electrical connector for connecting an IC package with a printed circuit board (PCB).

2. Description of the related art

Various electrical connectors are widely used in computer and other electronic devices. An electrical connector for electrically connecting an IC package to a printed circuit board (PCB) typically comprises an insulating housing and a plurality of contacts retained therein. The contacts connect the IC package and the PCB so as to establish an electrical connection therebetween. However with increasing of the amount and speed of the data transmitted by the contacts, the arrangement density of the contacts increases and the crosstalk between the contacts becomes more and more serious. Therefore, an electrical connector with shielding plates around the contacts is provided. CN Patent No. 202196955 issued on Apr. 18, 2012 discloses an electrical connector. The electrical connector comprises an insulating housing having a plurality of receiving holes, a plurality of contacts received in the receiving holes and a metallic frame insert-molded in the insulating housing and surrounding the contacts. The metallic frame can reduce the crosstalk between the contacts. However, as the insulating housing is make from plastic material integrally from top to bottom while the dielectric constant of the plastic material is relatively high, which result in a high crosstalk phenomenon of the electrical connector.

In view of the above, an improved electrical connector is desired to overcome the problems mentioned above.

SUMMARY OF THE INVENTION

Accordingly, an object of the present disclosure is to provide a low crosstalk electrical connector.

In order to achieve the object set forth, an electrical connector having low content of plastic is provided. The electrical connector comprises a plurality of contact units and a plurality of housing units retaining the contact units. The contact unit comprises an insulating body and a plurality of contacts retained therein. The housing unit comprises a shielding member defining an upper end and a lower end opposite to each other, an insulating cover on the upper end of the shielding member, and an insulating base on the lower end of the shielding member.

A cavity is defined between the insulating cover and the insulating base for decreasing the plastic content.

DESCRIPTION OF PREFERRED EMBODIMENT

Figure 1:
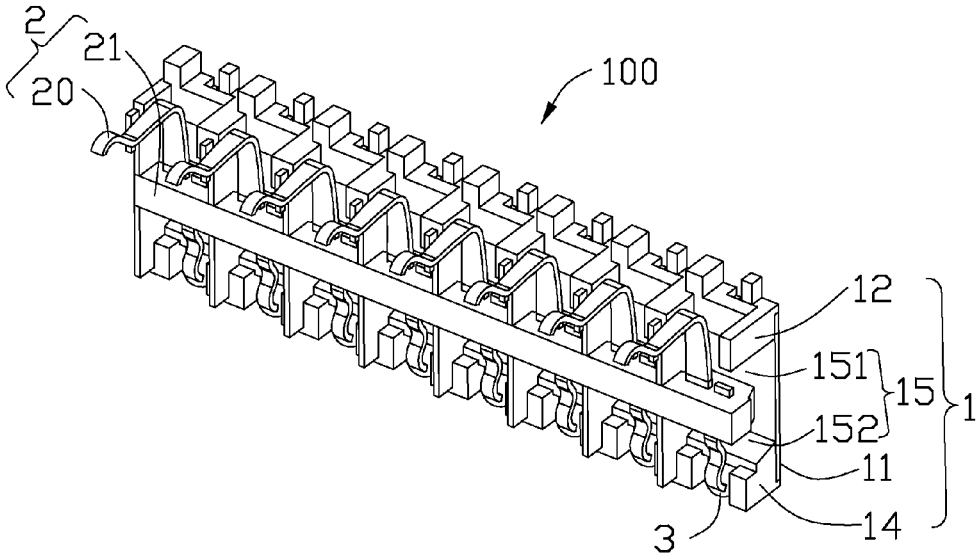
FIG. 1 is a perspective view of an electrical connector unit of an electrical connector in accordance with a preferred embodiment of the present disclosure.

Reference will now be made to the drawings to describe the present disclosure in detail.

Referring to FIGS. 1 to 4, an electrical connector for electrically connecting an IC package (not show) with a printed circuit board (not show) is provided. The electrical connector comprises a plurality of electrical connector units 100. The electrical connector unit 100 comprises a housing unit 1, a contact unit 2 and a plurality of solder balls 3.

Figure 2:
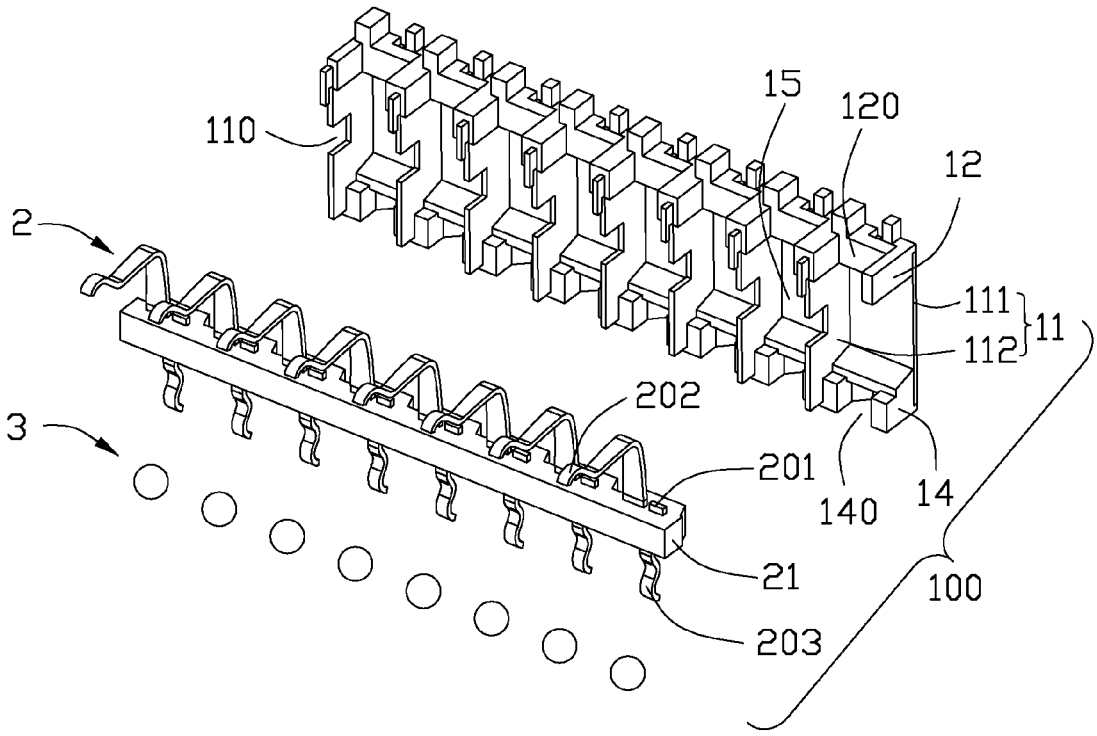
FIG. 2 is an exploded, perspective view of the electrical connector unit shown in FIG. 1.
Figure 3:
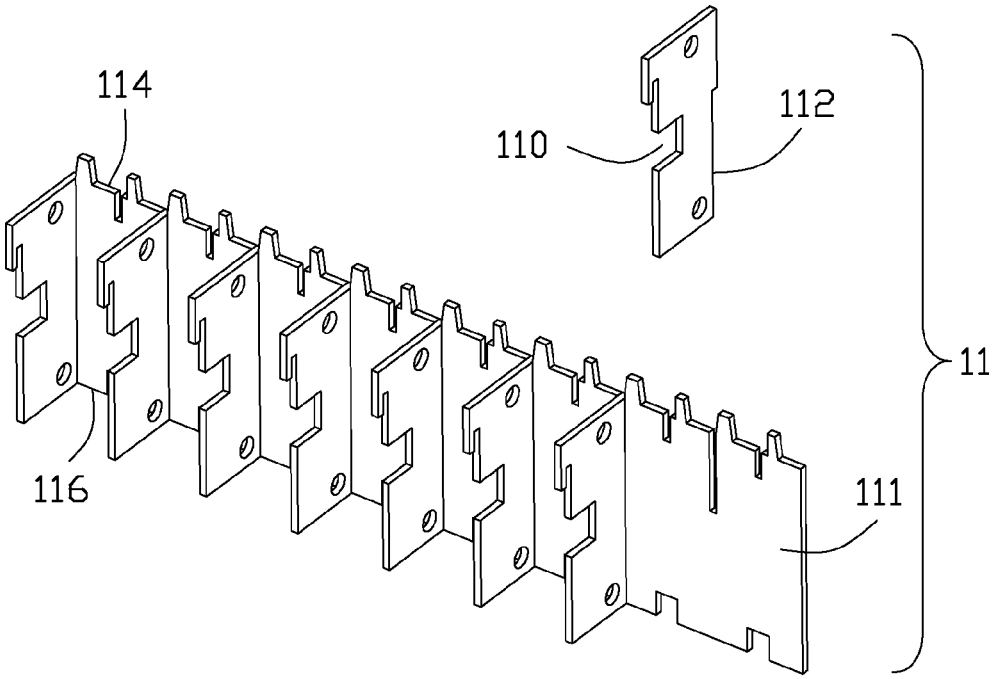
FIG. 3 is a perspective view of the shielding member of the electrical connector unit shown in FIG. 1.

Referring to FIG. 2 and FIG. 3, the contact unit 2 comprises a plurality of contacts 20 arranged in a row in a longitudinal direction and an insulating body 21 retaining the contacts 20. The contact 20 comprises a retention portion 201, an elastic arm 202 extending upwardly from the retention portion 201 and a soldering portion 203 extending downwardly from the retention portion 201. The insulating body 21 retains the retention portion 201 of the contact 20.

The housing unit 1 comprises a shielding member 11 extending in the longitudinal direction defining a plurality of chambers. The shielding member 11 defines an upper end 114 and a lower end 116 opposite to each other. The shielding member 11 comprises a first plate 111 extending in the longitudinal direction and a plurality of second plates 112 extending in a transverse direction perpendicular to the longitudinal direction. In this embodiment, the second plate 112 is assembled onto the first plate 111 while in other embodiment the second plate 112 can be formed by integrally stamped and bent from the first plate 111. The second plates 112 comprise a plurality of recesses 110 arranged in a row in the longitudinal direction.

The housing unit 1 comprises an insulating cover 12 defined on the upper end 114 of the shielding member 11 and an insulating base 14 defined on the lower end 116 of the shielding member 11. The insulating cover 12 comprises a plurality of receiving slots 120 for the elastic arms 202 of the contacts 20 extending therethrough. The insulating base 14 comprises a plurality of holes 140 for accommodating the solder balls 3 thereon. Both the insulating cover 12 and the insulating base 14 are made from plastic and insert-molded with the shielding member 11. The insulating cover 12 and the insulating base 14 are substantially parallel to each other in a vertical direction perpendicular to both the longitudinal direction and the transverse direction and define a cavity 15 therebetween. In this embodiment, there is no insulating plastic connecting the insulating cover 12 and the insulating base 14. The cavity 15 is formed by the insulating cover 12, the insulating base 14 and the shielding member 11.

Figure 4:
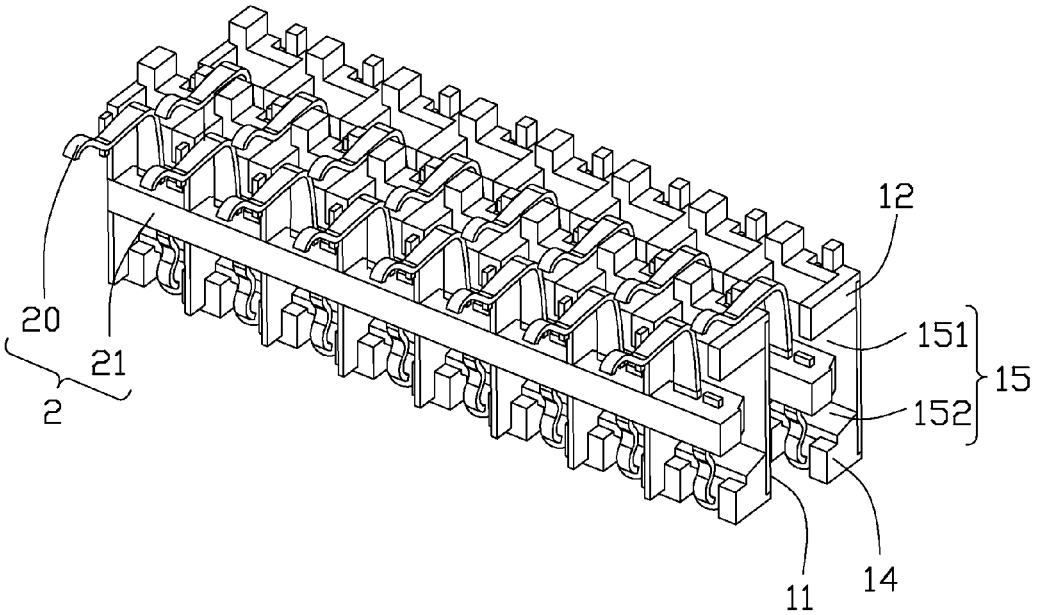
FIG. 4 is a schematic view of the electrical connector unit in FIG. 1, wherein the electrical connector units are assembled together.

Referring to FIG. 2 and FIG. 4, when assembling, the insulating body 21 of the contact unit 2 is assembled into the recesses 110 of the shielding member 11 in the transverse direction so as to form the electrical connector unit 100. The elastic arm 202 of the contact 20 extends upwardly through the receiving slot 120 of the insulating cover 12 while the soldering portion 203 extends downwardly into the hole 140 of the insulating base 14 retaining a solder ball 3. The insulating body 21 divides the cavity 15 into a first cavity 151 and a second cavity 152. The first cavity 151 is defined by the insulating cover 12, the insulating body 21 and the shielding member 11 while the second cavity 152 is defined by the insulating body 21, the insulating base 14 and the shielding member 11. Through assembling a plurality of electrical connector units 100 together side by side can form a matrix type arrangement wholly.

According to the above described embodiments, a low crosstalk electrical connector is provided. The electrical connector comprises a cavity 15 full of air between the insulating cover 12 and the insulating base 14. The electrical connector has low content of plastic materials so as to decrease the dielectric constant of the electrical connector and achieve a low crosstalk performance.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

a contact unit, comprising a plurality of contacts; and a housing unit receiving the contact unit, the housing unit comprising a shielding member defining an upper end and a lower end opposite to each other; wherein an insulating cover is seated on the upper end of the shielding member and an insulating base is seated on the lower end of the shielding member separated from each other forming a cavity therebetween.

2. The electrical connector as claimed in claim 1, wherein the shielding member comprises a plurality of recesses between the insulating cover and the insulating base, the contact unit comprises an insulating body retaining the contacts, and wherein the insulating body is assembled and retained into the recesses.

3. The electrical connector as claimed in claim 2, wherein the insulating body divides the cavity into two parts, the insulating cover, the insulating body and the shielding member defines one part while the insulating body, the insulating base and the shielding member defines the other part.

4. The electrical connector as claimed in claim 2, wherein the shielding member comprises a first plate and a plurality of second plates intersecting the first plate, the recesses are formed on the second plates.

5. The electrical connector as claimed in claim 1, wherein there is no plastic material between and connecting the insulating cover and the insulating base.

6. The electrical connector as claimed in claim 1, wherein the insulating cover comprises a plurality of receiving slots while the contacts comprise elastic arms extending upwardly through the receiving slots.

7. The electrical connector as claimed in claim 1, wherein the insulating base comprises a plurality of holes while the contacts comprise soldering portions extending downwardly into the holes.

8. The electrical connector as claimed in claim 1, wherein the contacts are insert-molded into the insulating body, the shielding member is insert-molded with the insulating cover and the insulating base.

9. An electrical connector for electrically connecting an IC package with a printed circuit board (PCB), comprising:

at least one contact unit, comprising an insulating body and a plurality of contacts retained therein; and at least one housing unit, comprising a metallic shielding member extending in a longitudinal direction, an insulating cover and an insulating base defined on the shielding member, the insulating cover and the insulating base substantially parallel to each other in a vertical direction perpendicular to the longitudinal direction defining a cavity therebetween; wherein;

the contact unit is assembled into the cavity of the housing unit in a transverse direction perpendicular to both the longitudinal direction and the vertical direction, and wherein the insulating body defines a space with the insulating cover or the insulating base.

10. The electrical connector as claimed in claim 9, wherein the shielding member comprises a first plate and a plurality second plates intersecting the first plate.

11. The electrical connector as claimed in claim 10, wherein the second plates comprise a plurality of recesses arranged in a row, the insulating body of the contact unit is retained in the recesses.

12. The electrical connector as claimed in claim 9, wherein there are a plurality of shielding members stacked with one another along the transverse direction with the associated housing units and contact units so as to form a matrix type arrangement wholly.

13. The electrical connector as claimed in claim 9, wherein the contact runs through the cavity in the vertical direction with an elastic arm extending upwardly above the insulating cover and a soldering portion extending downwardly into the insulating base.

14. An electrical connector comprising:

a metallic shielding member including a metallic first plate extending along a longitudinal direction, and a plurality of metallic second plates spaced from one another and attached to the first plate along said longitudinal direction, each of said second plates intersecting with the first plate and extending along a transverse direction perpendicular to said longitudinal direction; and a contact unit including an insulator extending along said longitudinal direction and a plurality of contacts retained by said insulator; wherein said the insulator is secured to the corresponding second plates to assemble the shielding member and the contact unit together.

15. The electrical connector as claimed in claim 14, wherein each of said contacts includes a contacting arm extending along the transverse direction in a top view.

16. The electrical connector as claimed in claim 14, wherein the shielding member is formed with an insulating base extending along a bottom side of the first plate and defining a plurality of holes to hold corresponding solder balls.

17. The electrical connector as claimed in claim 16, wherein the insulator is spaced from the base with a distance in a vertical direction perpendicular to both said longitudinal direction and said transverse direction.

18. The electrical connector as claimed in claim 17, wherein the shielding member is formed with an insulating cover extending along a top side of the first plate and spaced from the insulator in the vertical direction.

19. The electrical connector as claimed in claim 14, wherein a middle portion of the first plate in a vertical direction perpendicular to both the longitudinal direction and the transverse direction, is exposed to the corresponding contacts in the transverse direction.

20. The electrical connector as claimed in claim 14, wherein the second plates and the insulator are configured to allow the insulator to be assembled to the corresponding second plates in said transverse direction.

* * * * *